US005909020A

United States Patent [19]

Gallone

[11] Patent Number: 5,909,020

[45] Date of Patent: Jun. 1, 1999

[54] SWITCHING DEVICE FOR CONNECTIONS BETWEEN ELECTRIC CIRCUITS

[75] Inventor: Flavio Gallone, Fenegro', Italy

[73] Assignee: Signal Lux Italia, S.p.A., Milan, Italy

[21] Appl. No.: 09/073,678

[22] Filed: May 6, 1998

[30] Foreign Application Priority Data

Sep. 15, 1997 [EP] European Pat. Off. ..... 97830448

[51] Int. Cl.[6] ..... H01H 5/08

[52] U.S. Cl. ..... 200/438; 200/5 R; 200/164

[58] Field of Search ..... 200/339, 401, 200/438, 439, 408, 409, 553, 557

[56] References Cited

U.S. PATENT DOCUMENTS 3,671,693 6/1972 Farrell ..... 200/67 G 4,814,554 3/1989 Magiera ..... 200/6 R

*Primary Examiner*—Michael L. Gellner

*Assistant Examiner*—Nhung Nguyen

*Attorney, Agent, or Firm*—Laff, Whitesel, Conte & Saret, Ltd.

[57] ABSTRACT

A switching device for connections between electric circuits is provided, which comprises a toggle contact element oscillatably movable about a fulcrum, an operating push-button, and spring means interposed between the toggle element and the operating push-button and having a longitudinal axis substantially parallel to the fulcrum and susceptible of being elastically deformed by the operating push-button according to a side deflection relative to its own longitudinal axis.

11 Claims, 5 Drawing Sheets

SWITCHING DEVICE FOR CONNECTIONS BETWEEN ELECTRIC CIRCUITS

FIELD AND BACKGROUND OF THE INVENTION

The present invention relates to a switching device for connections between electric circuits comprising at least one toggle contact element oscillatably movable about a fulcrum between two operating end positions, one operating push-button adapted to exert a command force on said toggle element, said push-button being movable between two control positions corresponding to said two operating positions of the toggle element, and spring means interposed between said toggle contact element and operating push-button and adapted to exert an elastic thrust for locking said push-button to either one of said control positions and said toggle element to a corresponding one of the operating positions thereof.

It is known that switching devices for connections between electric circuits can, depending on their construction mode, perform various different functions, as on-off switches, double-throw switches and the like, for example.

Practically, each of said devices generally has, in addition to fixed contacts necessary for carrying out the intended function and integral with a support structure, a toggle contact element, that is an element oscillatably movable about a fulcrum between two operating end positions, each adapted to create an electric continuity for example, between the toggle element itself and one of the fixed contacts.

Displacement of the toggle element to either one of its operating positions is caused by an operating push-button manually operable between two stable control positions, each corresponding to one of the two operating positions of said toggle element.

The operating push-button, by interposition of appropriate actuator elements and spring means, is caused to exert an elastic command force on the toggle element which, when said toggle element is in its operating positions, is converted into an elastic locking thrust adapted to carry out a mating load between the movable and fixed contacts, which load should never be under a preestablished minimum value.

For example, in a first device of known type, the spring means consists of a spiral spring fitted in the operating push-button and having its longitudinal axis lying in a plane perpendicular to the plane of the toggle element fulcrum. Interposed between the spring, subjected to deformation in terms of shortening and lengthening along its own longitudinal axis, and the toggle element is a thrust element in the form of a ball or a runner which, during displacement of the push-button between its control positions, slides over a portion of the toggle element itself causing it to oscillate from one to the other of its operating positions.

In a second device of known type, the spring means consists of a longitudinal portion of the toggle element itself cut in the form of a blade so that it acts as a leaf spring, that is as a flexible element put into contact with a control finger or pin projecting inwardly from the operating push-button and integral therewith. In this second type of device as well, the end of the control pin, as the push-button is pressed and rotates, slides along the leaf-spring blade exploiting the elastic deformation in a plane transverse to the fulcrum and causes passage of the toggle element to a new operating position.

The known art briefly described above has some important limits and drawbacks.

In fact, first of all, both the above mentioned devices have elements that, by sliding on a portion of the toggle element, cause a friction force thereon of a non-negligible amount and corresponding to the elastic reaction exerted by the spring or the leaf-spring blade. This friction force inhibits an immediate tripping or jumping from one end position to the other of the push-button and therefore of the toggle element operated thereby, so that a user is obliged to press the push-button for some time in order to follow its movement for part of its displacement. Practically, above all after many operating cycles and consequently due to a partial yielding of the elastic elements, in some cases one or more unstable balance positions intermediate the end stability positions of the push-button and related toggle element can occur, thereby producing clear damages from the point of view of the electric operability.

In addition, the mentioned friction force gives rise to wear of the sliding elements in time and therefore limits the efficient operating duration of the device. On the other hand, in the known art it is impossible to select springs or leaf springs of lower elastic stiffness to limit sliding frictions, because electrically appropriate mating thrusts are to be ensured between the movable contact and fixed contacts.

It is to be added that the devices of known type, due to their structural conformation, carry out elastic thrusts of less amount on the toggle element, as the toggle element moves close to its operating end positions. In fact, for example, in the first-mentioned device the spiral spring of the compression type is more elongated at said end positions and therefore in this situation exerts less elastic force. Possible additional pressures on the command key that has already reached a stability end position lead to a further elongation of the elastic element and, instead of increasing the contact or mating force between the contacts, bring about a reduction in said force, that is a partial discharge between the contacts that can even give rise in some cases to formation of sparks and electric arcs.

This situation, which is particularly dangerous, may also occur in the case of devices subjected to vibrations, as it often happens in applications to apparatuses of various kinds which, by causing slight oscillations of the push-button and the toggle element about their operating positions, can give rise to reductions in the contact forces applied through the elastic elements.

From a construction point of view too the devices of known type have a structure which, for the purpose of keeping an assembled condition and therefore being able to be easily transported, requires a complete mounting of all its component parts and in particular the operating push-button. Under some situations this represents a serious limit because in this case it is necessary for said push-button to be selected already during the initial production step and cannot be optionally added in a subsequent time depending on the specific personalization requirements or operating needs.

SUMMARY OF THE INVENTION

Under this situation the technical task underlying the present invention is to provide a switching device for connections between electric circuits capable of substantially obviating the above mentioned drawbacks.

Within the scope of this technical task, it is an important aim of the invention to provide a switching device capable of ensuring a quick and immediate passage, also physically detectable by a user, from one of its operating positions to the other, as soon as the operating push-button is actuated, even by a short pulse.

Another important aim is to provide a device of high reliability after a great number of operating cycles and capable of ensuring a strong mating stability between the electric contacts also in case of vibrations or further manual pressures on the operating push-button.

A further aim is to provide a switching device which is advantageous for its production simplicity and has a structure formed of component parts capable of constituting a separate unit independently of whether the operating push-button has been mounted thereon or not.

The technical task mentioned and the aims specified are substantially achieved by a switching device for connections between electric circuits which is wherein said spring means has a longitudinal axis substantially parallel to said fulcrum and is adapted to be elastically deformed at least according to a side deflection relative to said longitudinal axis and in that said command force exerted by the operating push-button is applied to said spring means in a plane substantially transverse to said longitudinal axis.

BRIEF DESCRIPTION OF THE DRAWINGS

The description of a preferred but non-exclusive embodiment of a switching device in accordance with the invention is now given hereinafter, by way of non-limiting example, with the aid of the accompanying drawings, in which.

DESCRIPTION OF THE PREFERRED EMBODIMENT

Figure 1:
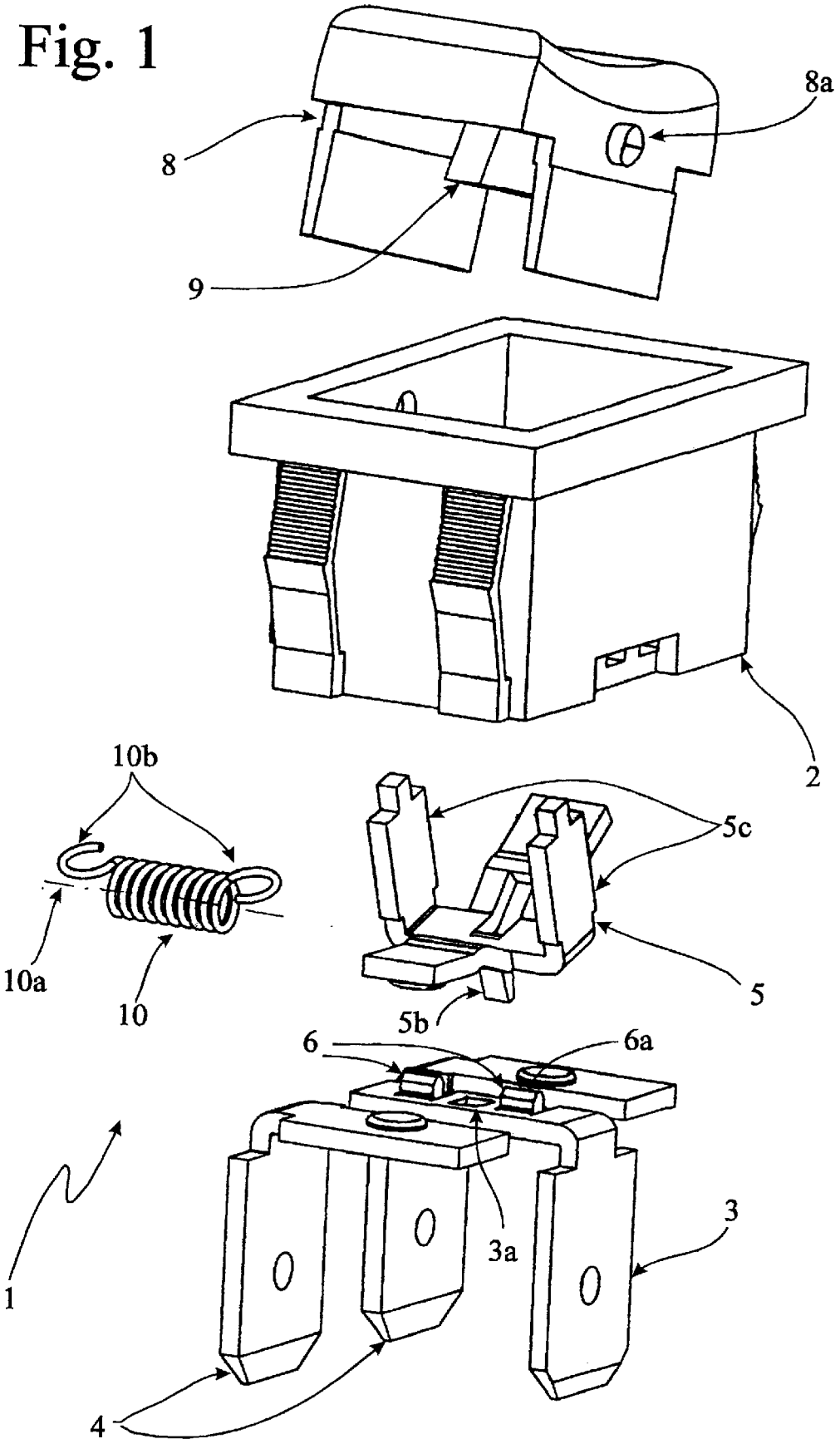
FIG. 1 is an exploded perspective view of the device in accordance with the invention.

With reference to the drawings, the switching device in accordance with the invention has been generally identified by reference numeral 1.

It comprises a support structure of an electrically insulating material to which fixed contacts can be fixedly fastened, which fixed contacts are equipped with respective electric connectors as provided for the device, a first central fixed contact 3 and a pair of second fixed side contacts 4, for example.

Oscillatably in engagement with the central fixed contact 3 is a toggle contact element 5, movable relative to a fulcrum 6 between two operating end positions. Fulcrum 6 is defined by a pair of edge portions of the central fixed contact 3 bent at 90° and having a sharp edge 6*a* adapted to be housed in a recess 7 formed in a central portion 5*a* of the toggle element 5 on a face thereof turned towards said edge portions.

Emerging from the central portion 5*a* of the toggle element 5 is an engagement tab 5*b* obtained by cutting and folding back a portion of the toggle element 5. Tab 5*b* is insertable in a through hole 3*a* of the fixed contact 3 and one end thereof 5*d* can be bent so as to fixedly join the toggle element 5 to the fixed contact 3.

An operating push-button 8 is rotatably in engagement with the support structure 2 by means of a pair of projecting pins 8*a* defining a rotation axis parallel to fulcrum 6 of the toggle element 5.

The operating push-button 8 has an actuating projection 9 turned inwardly towards the toggle element 5, which projection is adapted to exert a command force on the toggle element and is movable between two control positions corresponding to said operating end positions of the toggle element 5. Interposed between the toggle element 5 and the actuating projection 9 of the operating push-button 8 is spring means 10 adapted to exert an elastic locking thrust both on the push-button so as to lock it to one of said control positions and on the toggle element 5 so as to lock it to a corresponding one of its operating positions.

In an original manner, the spring means 10 has a longitudinal axis 10*a* oriented parallelly to fulcrum 6 and can be elastically deformed according to at least one side deflection relative to said longitudinal axis 10*a*.

Advantageously, the spring means 10 is defined by a traction spiral spring comprising ends 10*a* engaging a pair of actuation tailpieces 5*c* integral with the toggle element 5 and extending from the central portion 5*a* of said toggle element, that is close to recess 7 and fulcrum 6, so as to form a fork adapted to submit spring 10 to a pulling action.

Figure 2:
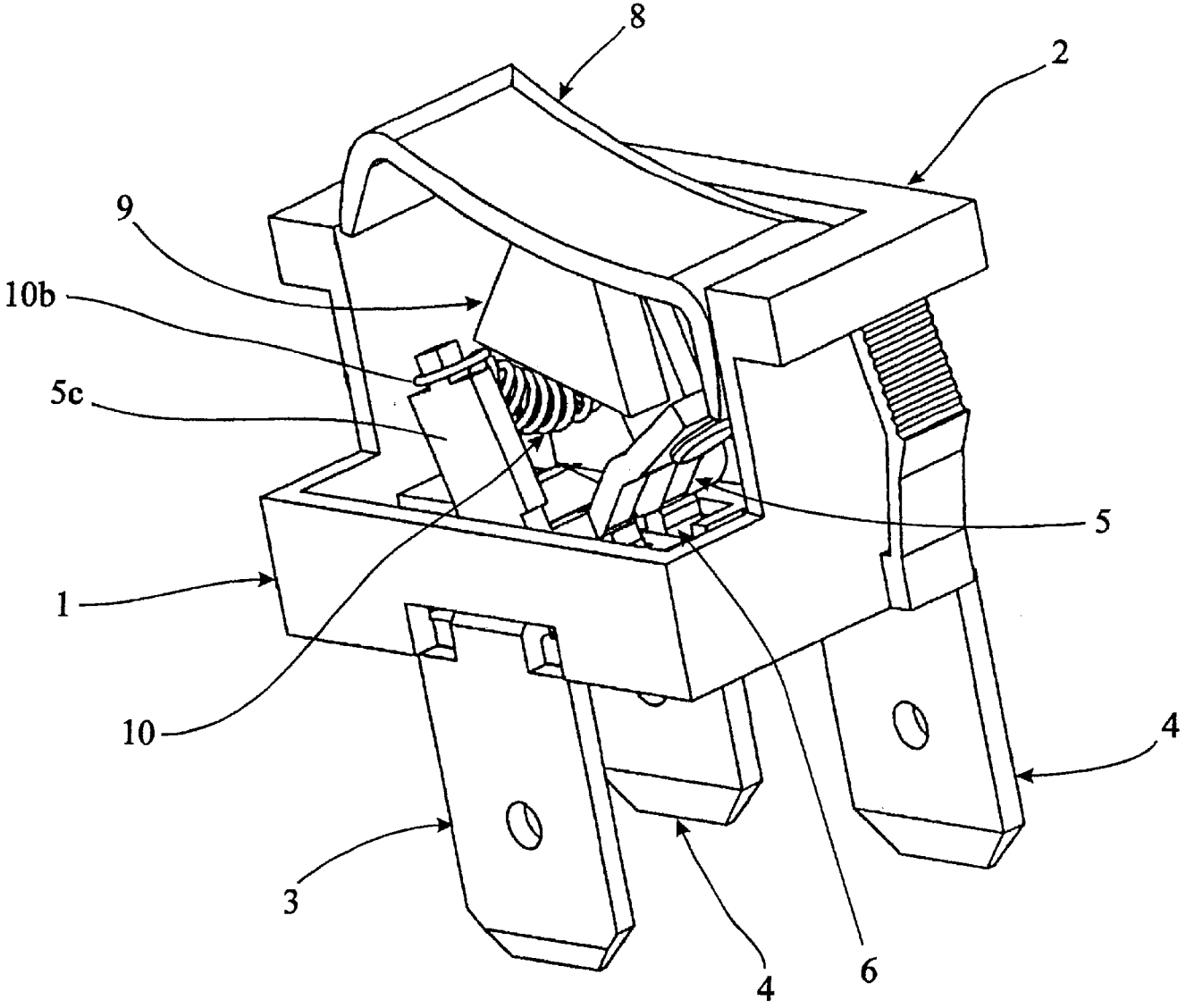
FIG. 2 is a fragmentary perspective view of the device shown in FIG. 1 in an assembled condition.
Figure 3:
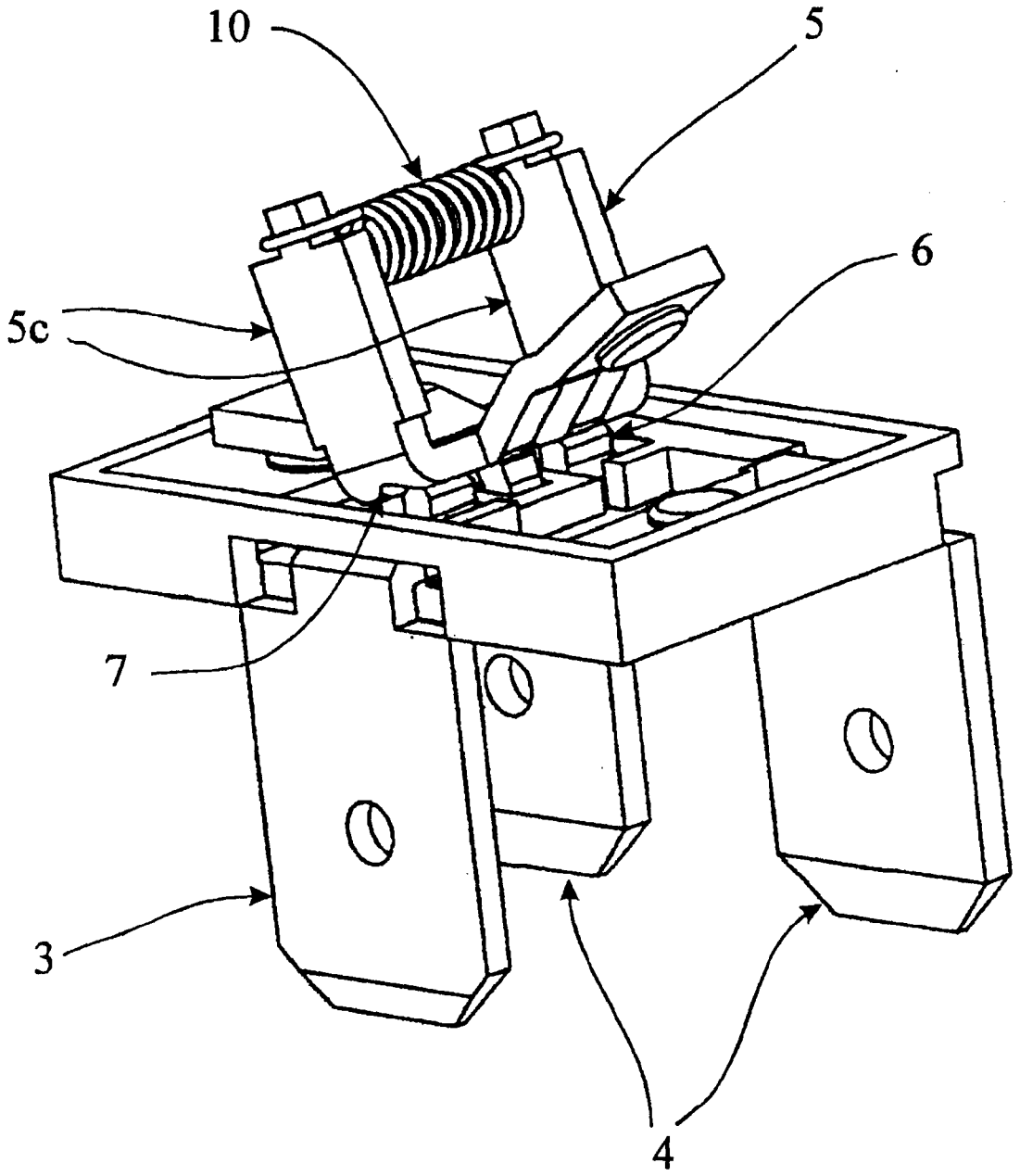
FIG. 3 shows a perspective view similar to FIG. 2 devoid of some parts and in particular the operating push-button and the support structure.
Figure 4:
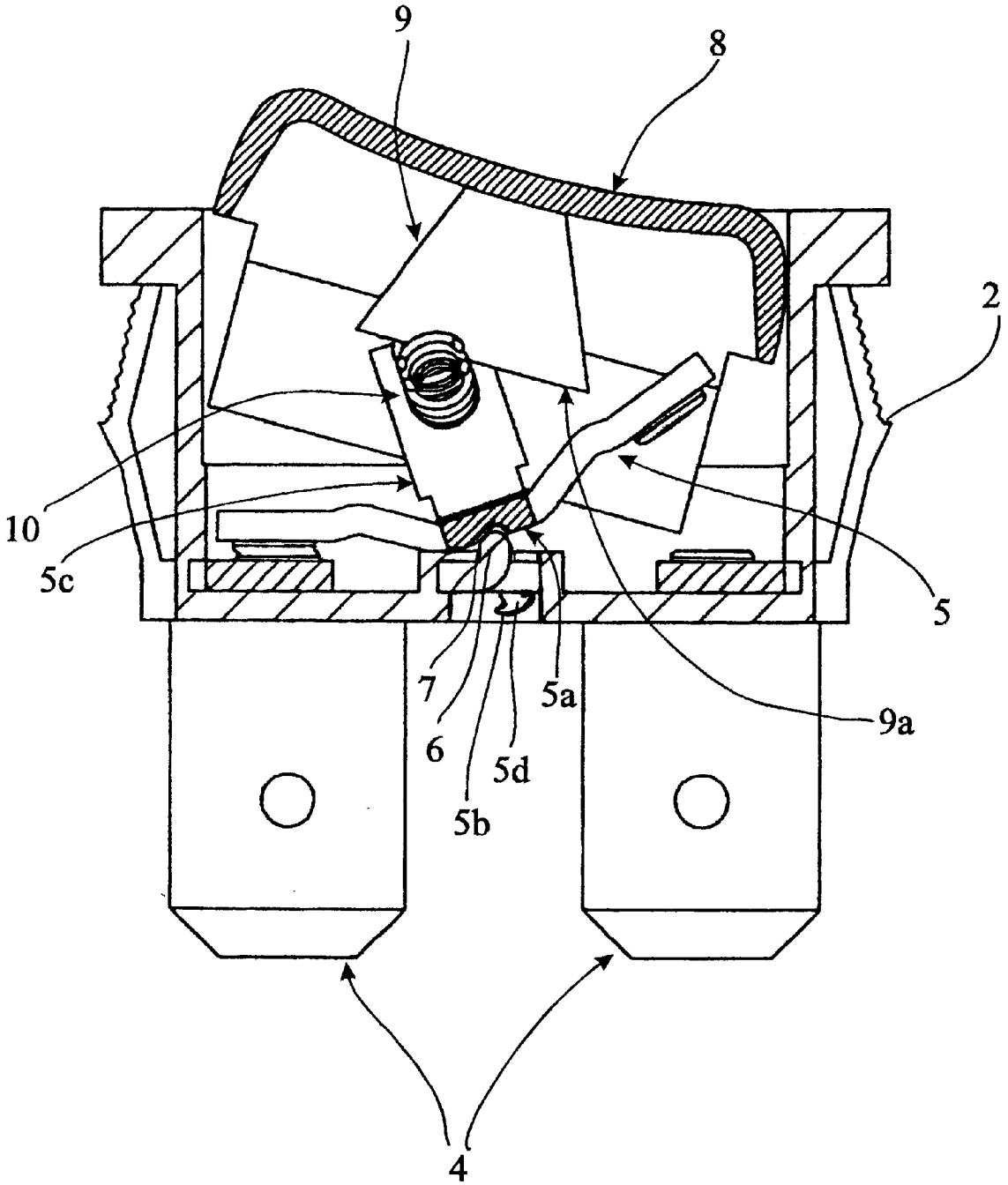
FIG. 4 is a sectional view of the device shown in FIG. 1 taken in a median plane perpendicular to the fulcrum of the toggle element of the device.

The command force exerted by the actuating projection 9 of the operating push-button 8 is applied to spring 10 in a plane substantially transverse to the longitudinal axis 10*a* of said spring. Practically, the actuating projection 9 has an active face 9*a* operatively in contact with a central region of the side surface of the spiral spring 10 (see FIGS. 2 and 4), so as to deflect said spring relative to its rectilinear conformation defined by the longitudinal axis 10*a* to a more or less marked extent, depending on the angular position of the toggle element 5 and operating push-button 8.

More specifically, oscillation of the operating push-button 8 and related actuating projection 9, instead of utilizing the conventional and known resiliency of a spring along its longitudinal-extension axis, exploits the spring capability of side deflection. This involves the presence of a side deflection causing an elastic force devoid of an intrinsic stability direction of its own, instead of involving a privileged and stable direction of the exerted elastic force coinciding with said longitudinal axis. It is therefore impossible that at the push-button intermediate positions stability settings of the push-button itself and the toggle element should take place and, as a result, stopping of said push-button and toggle element at undesired positions.

When the push-button is operated, a small displacement of the latter is sufficient so that the side deflection of spring 10 quickly passes from the position in which it is in the new stability configuration corresponding to the other operating position of the toggle element.

In addition, the actuating projection 9 slides to a reduced extent on the outer spring surface and, as a result, friction and wear practically do not exist.

The active face 9*a* of the actuating projection 9 has a profile conveniently studied for not reducing but preferably increasing the command force applied by the spring 10 itself and therefore also not reducing but increasing the elastic thrust exerted by spring 10 on the toggle element 5 during the oscillatory displacement of said toggle element in the direction of moving close to each of the operating end positions. Practically, this profile of the active face 9*a* must cause an increase in the length of the lever arm accomplished by the actuating projection 9 and consequently in the elastic load of spring 10 as the push-button 8 and toggle element 5 rotate towards their end positions or tend to go beyond said positions.

There are different embodiments of profile 9*a* that are capable of achieving the above described result.

Figure 5:
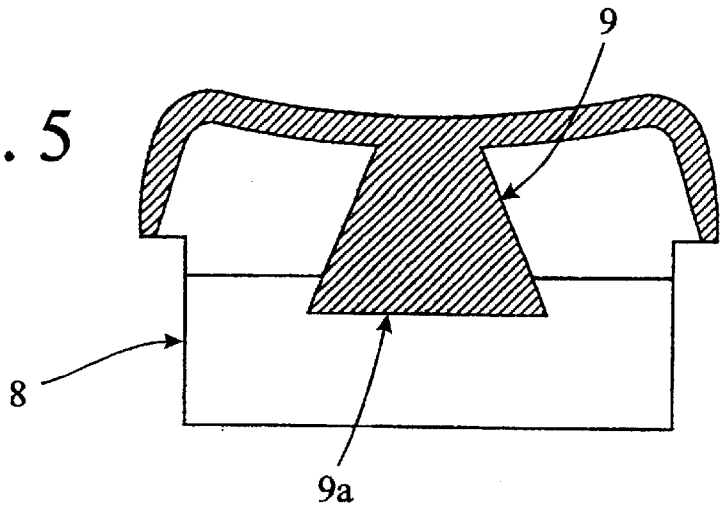
FIGS. 5, 6 and 7 show different embodiments of an actuating projection integral with the operating push-button.
Figure 6:
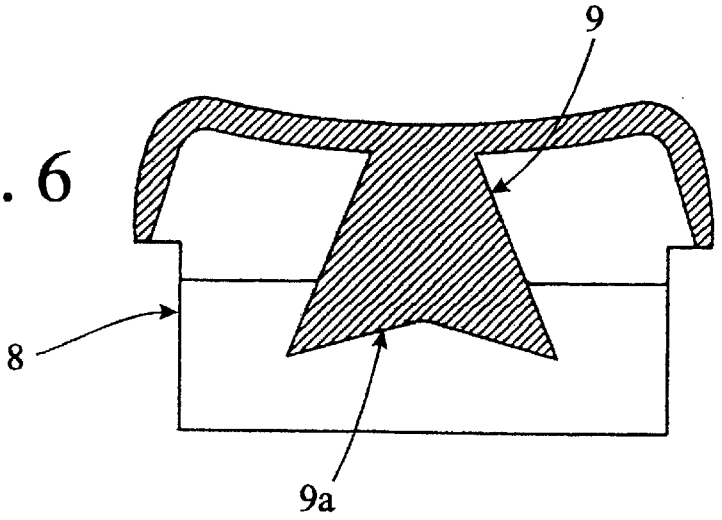
Figure 7:
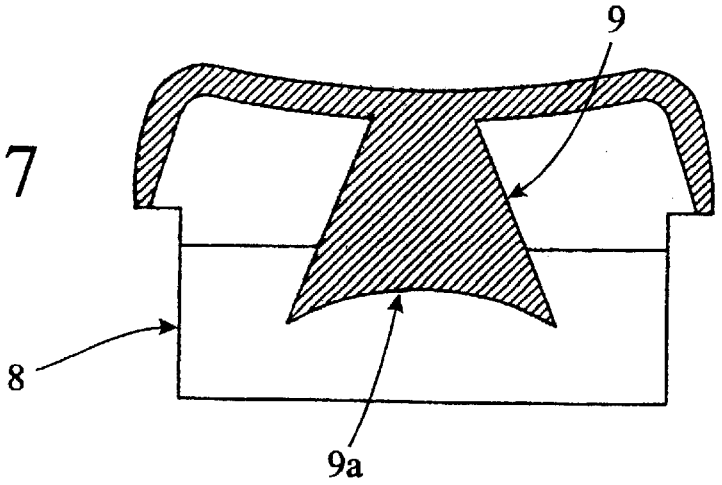

For example, in a first embodiment shown in FIG. 5, this profile has a rectilinear conformation. In a second embodiment shown in FIG. 6, profile 9*a* is defined by a broken line consisting of two rectilinear portions altogether defining a concavity facing spring 10. In a third embodiment shown in FIG. 7, profile 9*a* is defined by a curved line of the concave type too in which the edge of the active face 9*a* has increasing distances from the rotation pins 8*a* of the push-button 8 as it moves away towards the end points.

The invention achieves important advantages.

First of all, the device enables an immediate and sure tripping to either one of its operating end positions even after a short and pulsed operation by a user without the occurrence of undesired stop points at intermediate passage positions even after many operating cycles. Actually, instability of these intermediate positions does not undergo variations in time, neither do important wears in the side contact between the spiral spring and actuating projection of the operating push-button occur.

In addition, the mating force between the fixed and movable contacts does not undergo any reduction due to vibration or further operating pressure on the operating push-button because these stresses keep the elastic force exerted by the spring producing said mating force between contacts substantially constant or increase it.

It should be finally recognized that the toggle element can be fixedly linked, during the mounting step, to a fixed contact of the device and therefore the assembly formed of the spiral spring, toggle element, fixed contacts and support structure constitutes an assembled set of pieces that can be easily transported, if necessary, to other production stations for final mounting of the needed operating push-button in accordance with specific operating requirements. This feature, together with the limited number of pieces required and the easy accomplishment of same, makes production of devices in accordance with the invention particularly advantageous.

What is claimed is:

1. A switching device for connections between electric circuits comprising at least:

one toggle contact element (5) oscillatably movable about a fulcrum (6) between two operating end positions, one operating push-button (8) adapted to exert a command force on said toggle element (5), said push-button (8) being movable between two control positions corresponding to said two operating positions of the toggle element (5), and spring means (10) interposed between said toggle contact element (5) and said operating push-button (8) and adapted to exert an elastic thrust for locking said push-button (8) to either one of said control positions and said toggle element (5) to a corresponding one of the operating positions thereof, wherein said spring means (10) has a longitudinal axis (10*a*) substantially parallel to said fulcrum (6) and is adapted to be elastically deformed at least according to a side deflection relative to said longitudinal axis (10*a*), and in that said command force exerted by the operating push-button (8) is applied to said spring means (10) in a plane substantially transverse to said longitudinal axis (10*a*).

2. The device as claimed in claim 1, wherein said toggle element (5) has two actuation tailpieces ( 5*c*) arranged close to said fulcrum (6), said tailpieces ( 5*c*) defining a fork for engaging ends (10*b*) of said spring means (10).

3. The device as claimed in claim 2, wherein said spring means (10) is defined by a spiral spring.

4. The device as claimed in claim 2, wherein said operating push-button (8) comprises an actuating projection (9) adapted to exert said command force and having an active face (9*a*) operatively in contact with a central region of the side surface of said spring means (10).

5. The device as claimed in claim 4, wherein said active face (9*a*) has a profile of a conformation at least adapted not to reduce said elastic thrust exerted by said spring means (10) on said toggle element (5) during the oscillatory displacement of the toggle element itself in a direction for moving close to each of said operating end positions.

6. The device as claimed in claim 5, wherein said profile of the active face (9*a*) of said actuating projection (9) is substantially of rectilinear conformation.

7. The device as claimed in claim 5, wherein said profile of the active face (9*a*) of said actuating projection (9) has a substantially concave conformation.

8. The device as claimed in claim 5, wherein said profile of the active face (9*a*) of said actuating projection (9) is formed of a broken line consisting of rectilinear portions adapted to define a substantially concave conformation.

9. The device as claimed in claim 2, wherein said spiral spring has a spiraling pitch smaller than the actuating projection (9).

10. The device as claimed in claim 1, wherein it comprises a first fixed contact (3) disposed close to said fulcrum of the toggle element and at least one second fixed contact (4) adapted for matching with said toggle element (5) at one said operating position thereof, and in that said toggle element (5) has at least one engagement tab (5*b*) insertable in a through hole (3*a*) of said first fixed contact (3) and capable of being folded back during the mounting step in a manner adapted to fixedly link the toggle element (5) to said first fixed contact (3).

11. The device as claimed in claim 10, wherein said fulcrum (6) of said toggle element (5) is defined by at least one bent edge portion of said first fixed contact (3) having a sharp edge (6*a*) adapted to be housed in a recess (7) of said toggle element (5).

* * * * *